US007322920B2

(12) United States Patent
Johnson

(10) Patent No.: US 7,322,920 B2
(45) Date of Patent: Jan. 29, 2008

(54) EASY-OPEN SHROUDED SLIDER-ZIPPER ASSEMBLY FOR RECLOSABLE BAG

(75) Inventor: Joel L. Johnson, Stockbridge, GA (US)

(73) Assignee: Illinois Tool Works Inc., Glenview, IL (US)

( * ) Notice: Subject to any disclaimer, the term of this patent is extended or adjusted under 35 U.S.C. 154(b) by 567 days.

(21) Appl. No.: 10/759,800

(22) Filed: Jan. 16, 2004

(65) Prior Publication Data

US 2005/0157959 A1 Jul. 21, 2005

(51) Int. Cl.
*B31B 1/84* (2006.01)

(52) U.S. Cl. ..... 493/213; 493/114; 493/394

(58) Field of Classification Search ..... 493/213, 493/394, 927, 114; 53/412, 133.4, 139.2
See application file for complete search history.

(56) References Cited

U.S. PATENT DOCUMENTS 3,780,781 A * 12/1973 Uramoto ..... 383/204
3,827,472 A * 8/1974 Uramoto ..... 383/204
3,839,128 A * 10/1974 Arai ..... 156/461
4,807,300 A * 2/1989 Ausnit et al. ..... 383/65
4,846,585 A * 7/1989 Boeckmann et al. ..... 383/5
4,874,257 A * 10/1989 Inagaki ..... 383/63
4,894,975 A * 1/1990 Ausnit ..... 53/412
4,927,271 A * 5/1990 Branson ..... 383/5
4,966,470 A * 10/1990 Thompson et al. ..... 383/210.1
4,971,454 A 11/1990 Branson et al. ..... 383/61
5,022,530 A * 6/1991 Zieke ..... 383/204
5,121,997 A 6/1992 La Pierre et al. ..... 383/203
5,186,543 A 2/1993 Cochran ..... 383/203
5,211,482 A 5/1993 Tilman ..... 383/202
5,425,216 A * 6/1995 Ausnit ..... 53/410
5,456,928 A 10/1995 Hustad et al. ..... 53/412
5,826,401 A 10/1998 Bois ..... 53/412
5,875,611 A 3/1999 Plourde ..... 53/412
6,993,886 B2 * 2/2006 Johnson ..... 53/412

* cited by examiner

*Primary Examiner*—Sameh H. Tawfik
(74) *Attorney, Agent, or Firm*—Ostrager Chong Flaherty & Broitman P.C.

(57) ABSTRACT

A reclosable package comprises a pre-made bag with a post-applied shrouded slider-zipper assembly installed in the mouth of the bag. The bag material comprises a layer made of paper and a layer of thermoplastic material laminated to the paper layer. The shrouded slider-zipper assembly comprises a pair of flanged zipper parts made of thermoplastic material, a slider mounted to the zipper, and a folded web of thermoplastic film material joined to the layer of thermoplastic material of the bag. The flanges of the zipper parts are respectively joined to opposing sides of the folded web. The package is made by an automated process whereby an individual shrouded slider-zipper assembly is cut from a continuous chain of assemblies, inserted into the open mouth of a pre-made bag and tack sealed in place. The assembly is then fully sealed to the bag by a drag sealer.

8 Claims, 8 Drawing Sheets

EASY-OPEN SHROUDED SLIDER-ZIPPER ASSEMBLY FOR RECLOSABLE BAG

BACKGROUND OF THE INVENTION

This invention generally relates to slider-operated flexible zippers for use in reclosable pouches, bags or other packages. In particular, the invention relates to gusseted reclosable packages having slider-operated zippers.

Reclosable fastener assemblies are useful for sealing thermoplastic pouches or bags. Such fastener assemblies often include a thermoplastic zipper and a slider. Typically, the thermoplastic zippers include a pair of interlockable fastener elements, or profiles, that form a closure. As the slider moves across the profiles, the profiles are opened or closed. The profiles in plastic zippers can take on various configurations, e.g. interlocking rib and groove elements having so-called male and female profiles, interlocking alternating hook-shaped closure members, etc.

In one type of slider-operated zipper assembly, the slider straddles the zipper and has a separating finger at one end that is inserted between the profiles to force them apart as the slider is moved along the zipper in an opening direction. The other end of the slider is sufficiently narrow to force the profiles into engagement and close the zipper when the slider is moved along the zipper in a closing direction.

Other types of slider-operated zipper assemblies avoid the use of a separating finger. For example, U.S. Pat. No. 5,442,838 discloses a slider-operated zipper assembly wherein the zipper profiles are engaged and disengaged in the course of a "rolling action". This "rolling action" is described as being achieved through cooperation between flanges on the profiles and shoulders that project inwardly from the arms of the slider. U.S. Pat. No. 6,047,450 discloses a zipper comprising a pair of mutually interlockable profiled structures. The first profiled structure comprises an interlocking element on a surface directed toward the second profiled structure and an integral base directed away from the second profiled structure. Likewise, the second profiled structure comprises an interlocking element on a surface directed toward the first profiled structure and an integral base directed away from the first profiled structure. Additionally, portions of the two profiled structures form a fulcrum about which the profiled structures may be pivoted out of engagement when lower edges of the bases are forced towards each other by the slider.

Gusseted bags having thermoplastic zippers are well known in the reclosable packaging art. One advantage of such gusseted bags is that they may be opened more fully to facilitate filling the bag and later removing its contents. In some designs a gusseted side of the bag can be used to form a pouring spout by pulling the gusset outward and then inverting the bag, in which event the pourable contents of the package can be made to pour down the v-shaped channel formed by the gusset panels.

In the pet food industry, dry pet food is often packaged in a gusseted bag made of a laminated material. The outermost layer of the laminate is made of paper having a finish suitable for printing thereon. The innermost layer of the laminate is a sealant layer made of plastic material. This sealant layer allows the contents of the bag to be hermetically sealed to maintain freshness. An intermediate layer of the laminate is made of brown paper.

There is a need for alternative designs of gusseted bags having slider-operated thermoplastic zippers. In particular, there is a need for a design in which bags of pet food of the type described in the previous paragraph may be provided with slider-operated thermoplastic zippers.

BRIEF DESCRIPTION OF THE INVENTION

The invention is directed in part to the application of shrouded slider-operated zippers to pre-made flexible bags. This aspect of the invention is not limited to gusseted bags or bags made of paper. The invention is also directed to methods and apparatus for manufacturing such reclosable bags.

More specifically, one aspect of the invention is a reclosable bag comprising: a receptacle having an interior volume at least partially filled with product and a mouth at the top of the interior volume; a shroud having a generally U-shaped profile, the shroud defining a shrouded space and comprising a first surface on one side of the shroud that bounds the shrouded space and a second surface on the other side of the shroud that faces outward, wherein a first portion of the shroud is joined to the first wall and a second portion of the shroud is joined to the second wall, the shroud covering the mouth of the receptacle with at least a portion of the shrouded space being disposed outside of the interior volume of the receptacle; and a slider-zipper assembly disposed in the shrouded space and joined to third and fourth portions of the shroud on opposing sides of the shrouded space.

Another aspect of the invention is a reclosable bag comprising: a receptacle comprising first and second walls that partly define an interior volume, the receptacle having a mouth at the top of the interior volume and being closed at the bottom; a shroud having a generally U-shaped profile, the shroud defining a shrouded space and comprising a first surface on one side of the shroud that bounds the shrouded space and a second surface on the other side of the shroud that faces outward, wherein a first portion of the shroud is joined to the first wall and a second portion of the shroud is joined to the second wall, the shroud covering the mouth of the receptacle with at least a portion of the shrouded space being disposed outside of the interior volume of the receptacle; a flexible zipper disposed within the shrouded space and comprising first and second flanged zipper parts, the first flanged zipper part comprising a first profiled closure member and a first flange, and the second flanged zipper part comprising a second profiled closure member and a second flange, the first and second profiled closure members being mutually interlockable, the first flange having a portion joined to a third portion of the shroud, and the second flange having a portion joined to a fourth portion of the shroud, the third and fourth portions of the shroud being on opposite sides of the shrouded space, the first and second portions of the shroud being located intermediate the third and fourth portions; and a slider mounted to the zipper and configured to close portions of the zipper as the slider is moved in, a first direction along the zipper and to open portions of the zipper as the slider is moved in a second direction along the zipper opposite to the first direction.

A further aspect of the invention is a method of manufacture comprising the following steps: (a) mounting a slider to a zipper comprising interlocked first and second zipper strips; (b) folding a length of a web along a fold line; (c) joining a portion of a length of a first flange of the first zipper strip to a first portion of the length of the web; (d) joining a portion of a length of a second flange of the second zipper strip to a second portion of the length of the web, the first and second portions of the length of the web being on opposite sides of the fold line; (e) cutting the joined lengths of the web and the zipper along first and second lines generally perpendicular to the first edge to form an individual shrouded slider-zipper assembly that includes the slider; (f) joining a third portion of the length of the web to a first portion of a pre-made bag that partly defines a mouth; and (g) joining a fourth portion of the length of the web to a second portion of the pre-made bag that partly defines the mouth.

Yet another aspect of the invention is a reclosable bag comprising: a receptacle comprising a first layer made of paper and a layer of thermoplastic material laminated to the first layer, the receptacle having a mouth and an interior volume; a shrouded slider-zipper assembly attached to the mouth of the receptacle, the shrouded slider-zipper assembly comprising first and second flanged zipper parts made of thermoplastic material, a slider mounted to the first and second zipper parts, and a folded web of thermoplastic film material joined to the layer of thermoplastic material of the receptacle, the first flanged zipper part comprising a first profiled closure member and a first flange, and the second flanged zipper part comprising a second profiled closure member and a second flange, the first and second profiled closure members being mutually interlockable, the first flange having a portion joined to one side of the folded web, and the second flange having a portion joined to the other side of the folded web; and product contained inside the interior volume of the receptacle.

A further aspect of the invention is an automated system comprising: means for mounting a slider to a zipper comprising interlocked first and second zipper strips; means for folding a length of a web along a fold line; means for joining a portion of a length of a first flange of the first zipper strip to a first portion of the length of the web; means for joining a portion of a length of a second flange of the second zipper strip to a second portion of the length of the web, the first and second portions of the length of the web being on opposite sides of the fold line; means for cutting the joined lengths of the web and the zipper along first and second lines generally perpendicular to the first edge to form an individual shrouded slider-zipper assembly that includes the slider; means for joining a third portion of the length of the web to a first portion of a pre-made bag that partly defines a mouth; and means for joining a fourth portion of the length of the web to a second portion of the pre-made bag that partly defines the mouth.

Other aspects of the invention are disclosed and claimed below.

BRIEF DESCRIPTION OF THE DRAWINGS

Reference will now be made to the drawings, in which similar elements in different drawings bear the same reference numerals.

DETAILED DESCRIPTION OF THE INVENTION

Figure 1:
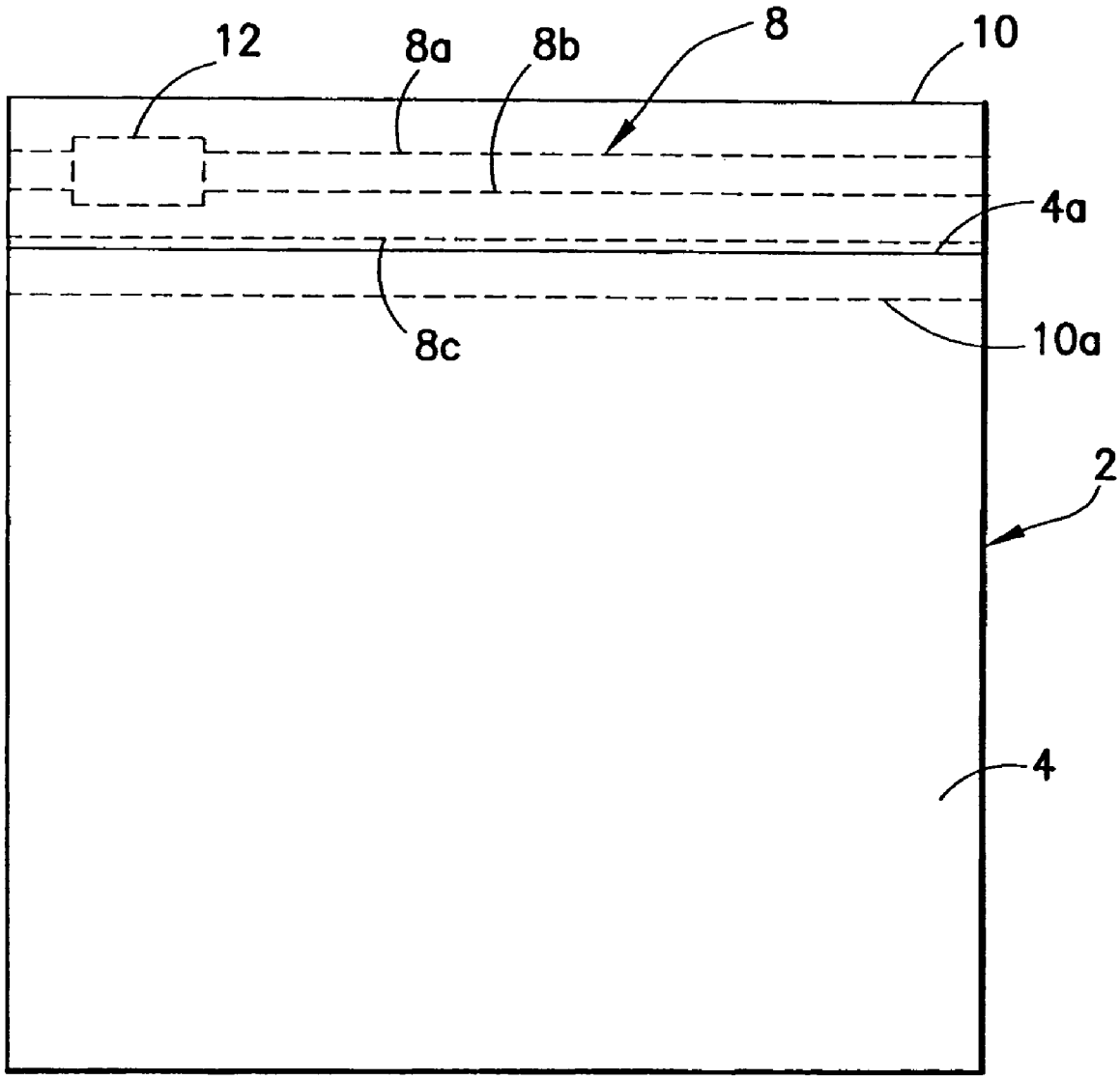
FIG. 1 is a drawing showing a front view of a reclosable bag having a shrouded slider-zipper assembly in accordance with one embodiment of the invention. The size of the assembly relative to the size of the bag has been exaggerated for illustrative purposes. [For example, in a 50-bag of pet food, the shroud would have a height of about 3 inches, while the bag would have a height that is greater by at least a factor of 10.]

A reclosable bag in accordance with one embodiment of the invention is shown in FIG. 1. The reclosable bag comprises a receptacle 2 formed by front and rear walls interconnected by a bottom wall and respective expanding gusseted side walls. Only the front wall 4 is visible in the view shown in FIG. 1. The receptacle 2 may be made from any suitable sheet material including plastic film or paper or laminated material. For example, in one embodiment of the invention, the receptacle 2 is made of a laminated material comprising an inner sealant layer made of thermoplastic material, an outer layer made of paper having an outer surface suitable for printing, and an intermediate layer made of brown paper. Such a construction can be used to make reclosable bags for pet food, for example. However, it should be appreciated at the outset that the various aspects of the present invention are not limited to use with paper/plastic laminated bags, but also have application in bags made of thermoplastic material without paper layers.

Figure 2:
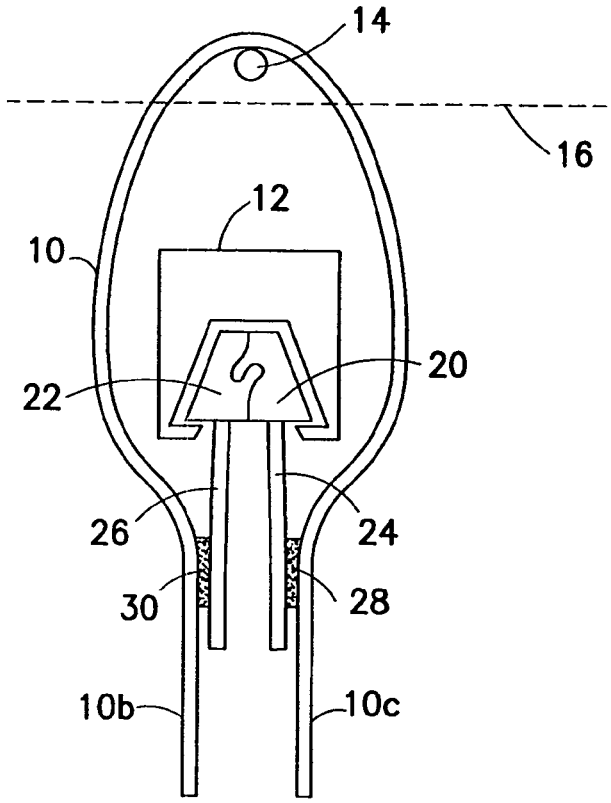
FIG. 2 is a drawing showing a sectional view of a shrouded slider-zipper assembly in accordance with one embodiment of the invention.

Reference numeral 4*a* in FIG. 1 designates the top edge of front wall 4 of the receptacle 2. The structure 10, which extends above the top of the receptacle 2, is a shroud comprising a folded web that has an inverted U-shaped profile. The free sides or legs of the folded web extend into the mouth of the receptacle, the bottom edge of the front side of the shroud 10 being indicated by dashed line 10*a*. The exterior surfaces of the sides of shroud 10 are heat sealed to interior surfaces of the receptacle 2, as will be explained in more detail below with reference to FIG. 5. The interior surface of the inverted U-shaped shroud 10 forms the boundary of a shrouded space in which a slider-zipper assembly is disposed, as best seen in FIG. 2.

The slider-zipper assembly comprises an extruded plastic zipper 8 and a molded plastic slider 12 mounted thereto. In FIG. 1, the zipper is represented by the three horizontal dashed lines above the solid line 4*a*. The region bounded by dashed lines 8*a* and 8*b* represents a profiled closure, while the region bounded by dashed lines 8*b* and 8*c* represents a flange or fin having one end connected to the profiled closure member.

The zipper is best described with reference to FIG. 2. The zipper 8 comprises first and second flanged zipper parts. The first flanged zipper part comprises a first profiled closure member 22 and a first flange 26, and the second flanged zipper part comprises a second profiled closure member 20 and a second flange 24. The profiled closure members 20 and 22 are mutually interlockable. Flange 24 has a portion joined to an opposing portion on one side of the shroud 10, while the flange 2 has a portion joined to an opposing portion on the other side of the shroud 10. In other words, the zipper flanges are joined (i.e., heat sealed to form so-called "permanent" seals) to the interior of the shroud 10 on opposing sides of the shrouded space.

The slider 12 is mounted to the zipper and is configured to close portions of the zipper as the slider is moved in one direction along the zipper and to open portions of the zipper as the slider is moved in the opposite direction along the zipper in the manner disclosed in detail in U.S. Pat. No. 6,047,450, the disclosure of which is incorporated by reference herein.

Still referring to FIG. 2, the shroud 10 is provided with a pair of lines of weakened tear resistance (hereinafter "tear lines") at the two locations intersected by dashed line 16. However, two tear lines are not necessary, as one tear line would be sufficient to tear open the shroud. To facilitating tearing open, the shroud 10 is further provided with a plastic tear bead 14, which is typically gripped between the forefinger and the thumb by the consumer. This allows the cap of the shroud (i.e., the portion of the shroud above the dashed line 16) to be torn off, thereby allowing the consumer to have access to the slider-zipper assembly. The consumer can then gain access to the contents of the reclosable bag by moving the slider along the zipper in the opening direction, which causes the interlocked zipper parts to disengage.

Figure 4:
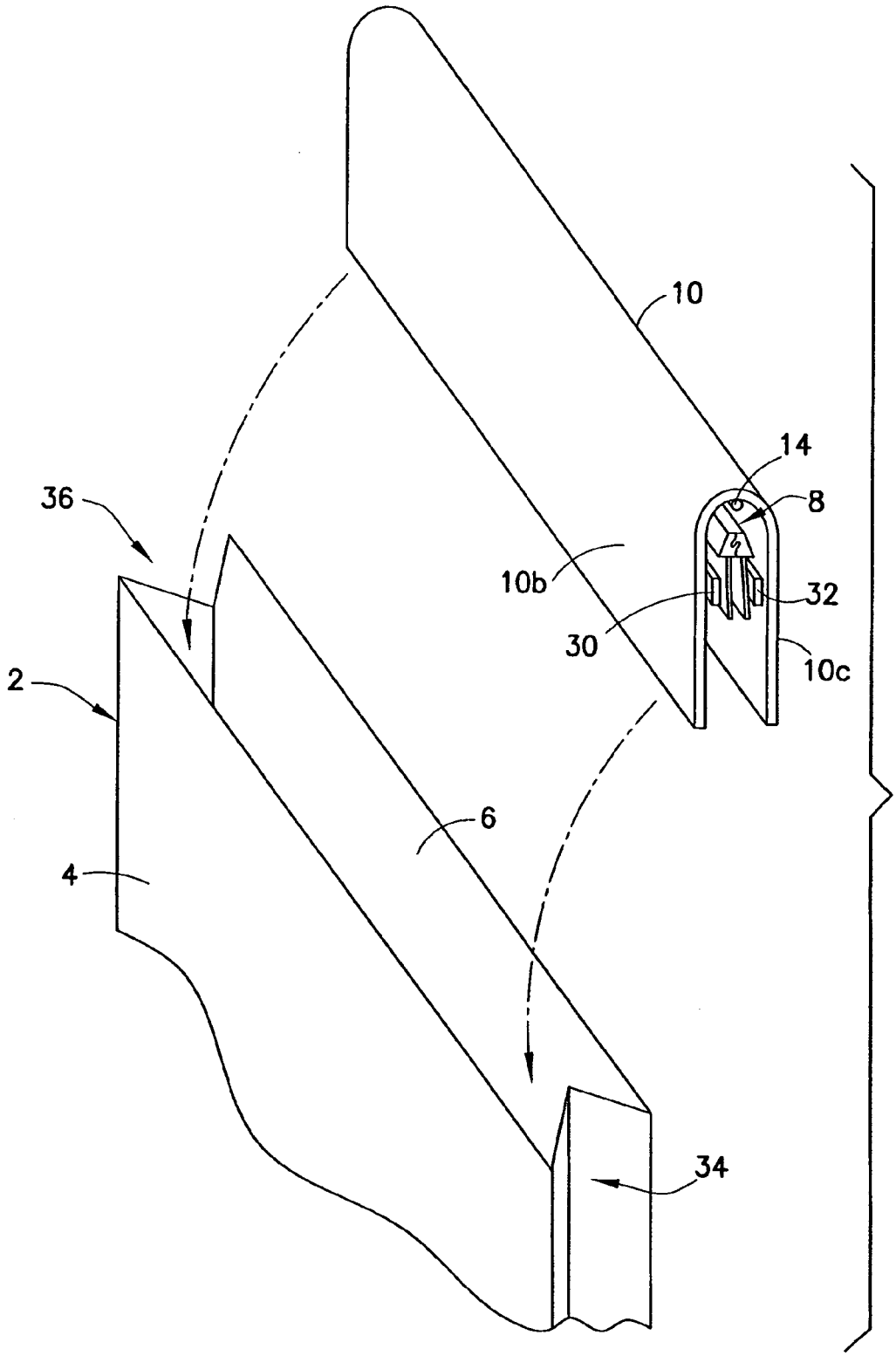
FIG. 4 is a drawing showing the insertion of the shrouded slider-zipper assembly into the mouth of a pre-made bag in accordance with one method of manufacture.

As best seen in FIG. 4, an individual shrouded slider-zipper assembly is inserted as a unit into the mouth of a pre-made bag or receptacle 2. In this example, the receptacle 2 comprises a front wall 4, a rear wall 6, a first side gusset 34 interconnecting the front and rear walls on one side of the bag, and a second side gusset 36 interconnecting the front and rear walls on the other side of the bag. Each side gusset comprises a respective pair of gusset panels that allow the sides of the bag to expand and contract at the gussets. In FIG. 4, the sides of the shroud 10 have been designated 10*b* and 10*c* and comprise opposing portions of the folded web that are connected by the fold.

Figure 5:
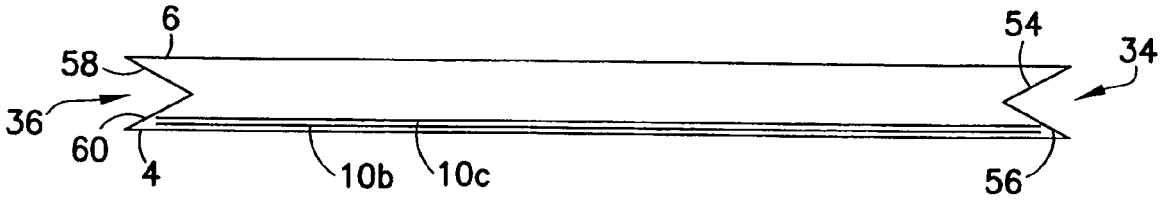
FIG. 5 is a schematic showing the respective positions of the walls of the shroud when inserted into the mouth of the pre-made bag in accordance with one method of manufacture.

As shown in FIG. 5, side gusset 34 comprises a panel 56 connected to the front wall 4, and a panel 54 connected to the panel 54 and to the rear wall 6. Similarly, side gusset 36 comprises a panel 60 connected to the front wall 4, and a panel 58 connected to the panel 60 and to the rear wall 6. The sides 10*b* and 10*c* of the shroud 10 (represented schematically in FIG. 5 by a pair of parallel lines) are inserted adjacent one of the receptacle walls, with the ends of the sides 10*b* and 10*c* intervening between that wall and the opposing gusset side panels. In the example shown in FIG. 5, one end of each side 10*b*, 10*c* of the shroud extends into the space between front wall 4 and panel 60 of side gusset 36, while the other end of each side 10*b*, 10*c* of the shroud extends into the space between front wall 4 and panel 56 of side gusset 34. Thereafter, the shroud is sealed in place by application of heat and pressure, which causes the thermoplastic material of the shroud to seal to or fuse with the inner thermoplastic sealant layer of the laminated receptacle 2 (the respective layers of the lamination are not shown in FIG. 5), with the paper layers as previously described being unaffected.

During the sealing operation (the components are shown not sealed in FIG. 5), a central portion of the rear wall 6 at the elevation of the shroud is pressed against the side 10*c* of the shroud 10, while end portions of the rear wall 6 are pressed against the respective gusset panels 54 and 58, causing a central portion of side 10*c* of the shroud 10 and respective portions of the sealant layer on the interior surfaces of the gusset panels 54 and 58 to seal to the sealant layer on the interior surface of the rear wall 6. At the same time, the side 10*b* of the shroud 10 is sealed to the sealant layer on the interior surface of the front wall 4, while respective portions of the sealant layer on the interior surfaces of the gusset panels 56 and 60 are sealed to end portions of side 10*c* of the shroud 10. The side panels are not sealed to each other because their exterior layers are made of paper. However, if desired, the side panels on each side can be glued together.

Figure 3:
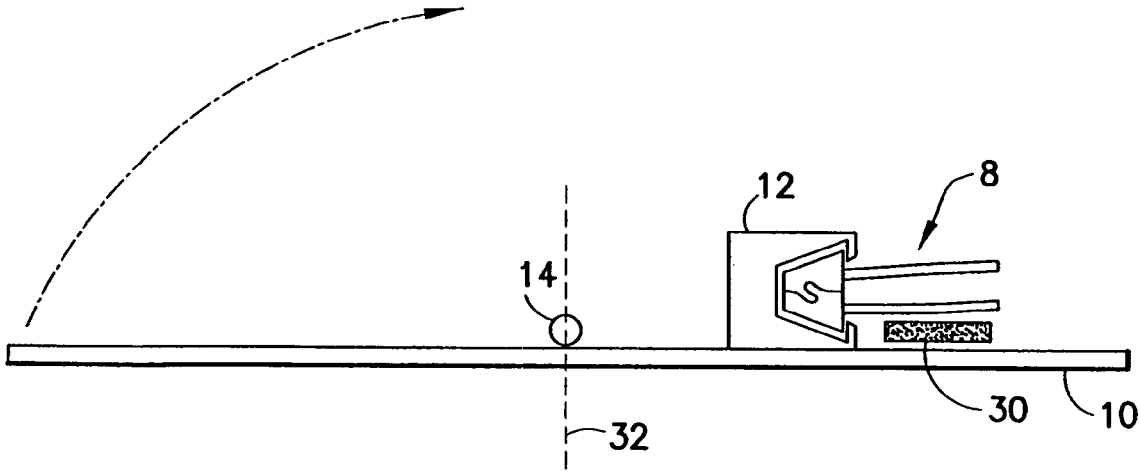
FIG. 3 is a drawing showing several steps of one method of manufacturing the shrouded slider-zipper assembly shown in FIG. 2.

FIG. 3 illustrates various steps of one method for making the shrouded slider-zipper assembly. A continuous strip of film 10 is laid flat, A slider-zipper assembly (comprising a multiplicity of sliders mounted to a continuous zipper at spaced intervals therealong) is laid on its side on top of the strip 10 in a lengthwise direction. Also a pull bead 14 is laid on top of strip 10 near (as seen in FIG. 3) or at and parallel to the centerline of the strip 10, which centerline is indicated by dashed line 32. The lower zipper flange is heat sealed to the strip 10 to form a permanent seal 30. Likewise the pull bead 14 is heat sealed to the strip 10. The strip 10 is then folded in half (indicated by the curved dash-dot arrow in FIG. 3) so that the folded-over portion of the strip overlies the slider-zipper assembly and the other half of the strip (not shown in FIG. 3). The folded-over portion of strip 10 is then heat sealed to the upper zipper flange to form a permanent seal (not shown in FIG. 3, but see item 28 in FIG. 2). In the folded-over and sealed configuration, the strip 10 becomes the previously described shroud 10.

Alternatively, instead of sealing one zipper flange, folding the web over, and then sealing the other zipper flange, first the web 10 is folded and then the slider-zipper assembly can be inserted between the sides of the folded shroud and sealed in place, the two zipper flanges being heat sealed concurrently by a pair of opposing heated sealing bars. The amount of heat applied in this operation can be controlled to prevent seal-through of the zipper flanges. Alternatively, seal-through can be prevented by placing a separator plate between the zipper flanges during the sealing operation.

The present invention is not limited to the particular slider and zipper structures depicted in FIG. 2. In the case of the particular slider-zipper assembly shown in FIG. 2, the slider 12 does not have a separating finger or plow. However, slider-zipper assemblies wherein the slider has a separating finger can be employed. With regard to the zipper, one zipper part may have a male closure profile and the other zipper part may have a female closure profile designed to receive and interlock with the male profile. Alternatively, the zipper may comprise alternating hook-shaped closure elements that interleave when the zipper halves are brought together.

Figure 6:
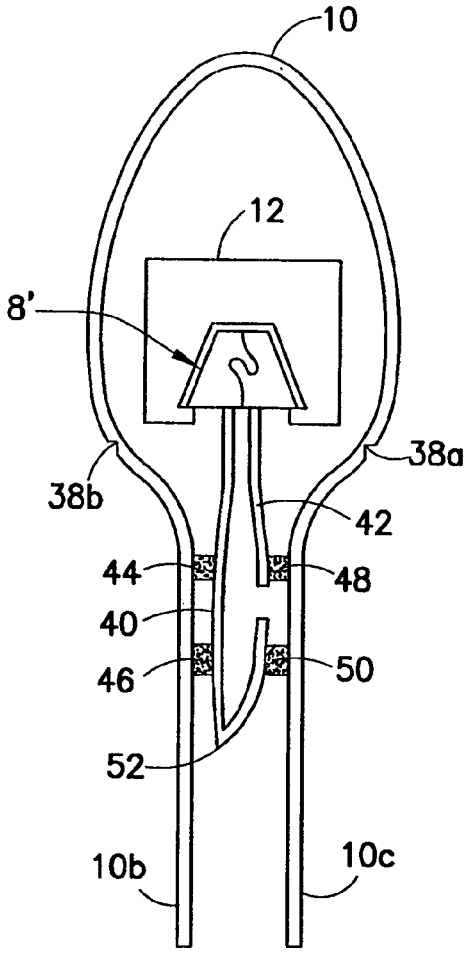
FIG. 6 is a drawing showing a sectional view of a shrouded split-flange slider-zipper assembly in accordance with another embodiment of the invention.

In FIG. 2, the zipper has flanges of generally equal length, one flange being joined to one side of the shroud and the other flange being joined to the other side of the shroud. FIG. 6 shows an alternative design wherein one zipper flange 40 is longer than the other zipper flange 42, and four-point sealing is used to attach the zipper 8' to the shroud 10. Zipper flange 42 is joined to side 10*c* of the shroud 10 by a permanent seal 48. Zipper flange 40, which is longer than flange 42, is joined to side 10*b* of shroud 10 by permanent seals 44 and 46. Flange 40 is further joined to side 10*c* of shroud 10 by a permanent seal 50, which is located below the seal 48. It should be appreciated that each of the seals 44, 46, 48 and 50 is a band of joined, e.g., fused, material that extends from one end of the shroud to the other end, thereby securing the zipper to the shroud along its length. In this disclosed embodiment, the seals 44 and 46 are generally parallel to each other, and the seals 48 and 50 are generally parallel to each other. Also, seals 44 and 48 are generally opposed to each other at one elevation, and seals 46 and 50 are generally opposed to each other at a lower elevation.

Still referring to FIG. 6, the long flange 40 may optionally have a line of weakened tear resistance that runs along the cusp 52. In that event, the terminal section of flange 40 (extending from the cusp 52 to the distal end of the flange) would be separated from the remainder of flange 40 when the line of weakness is ruptured by the consumer. The line of weakness may take the form of a scoreline in the flange or a line of contamination in the extruded thermoplastic material of the flange. Alternatively, the line of weakening may comprise a line of perforations extending along the cusp 52. To maintain the barrier properties of flange 40, the line of perforations may be capped by a frangible strip (not shown in FIG. 6) of lightweight material, as disclosed in U.S. Pat. No. 5,023,122. This frangible strip seals the perforations, but tears readily when the flange is ruptured along the perforations. The sealing strip may be heat sealed to the perforated flange or the sealing strip may be adhesive backed to allow the strip to be bonded to the flange by adhesive. Alternatively, the sealing strip may be provided by extruding a thin layer of material over the perforations. The details of how to manufacture a sealing strip for capping perforations in a substrate are fully disclosed in U.S. Pat. No. 5,023,122, which is incorporated by reference herein.

The shroud 10 is provided with lines 38*a*, 38*b* of weakened tear resistance on both sides to allow the topmost or cap portion of the shroud to be removed. The tear lines 38*a*, 38*b* are disposed at an elevation below the zipper profiles so that the slider will be fully exposed and accessible to the consumer. After the cap portion of the shroud has been removed and the zipper has been opened by the consumer, the flange 40 still prevents access to the package contents. The intact flange 40 provides hermetic sealing. By bearing down on the flange 40 or simply separating the top ends of the bag, the line of weakness at the cusp 52 can be ruptured, thereby providing access to the contents of the bag.

Figure 7:
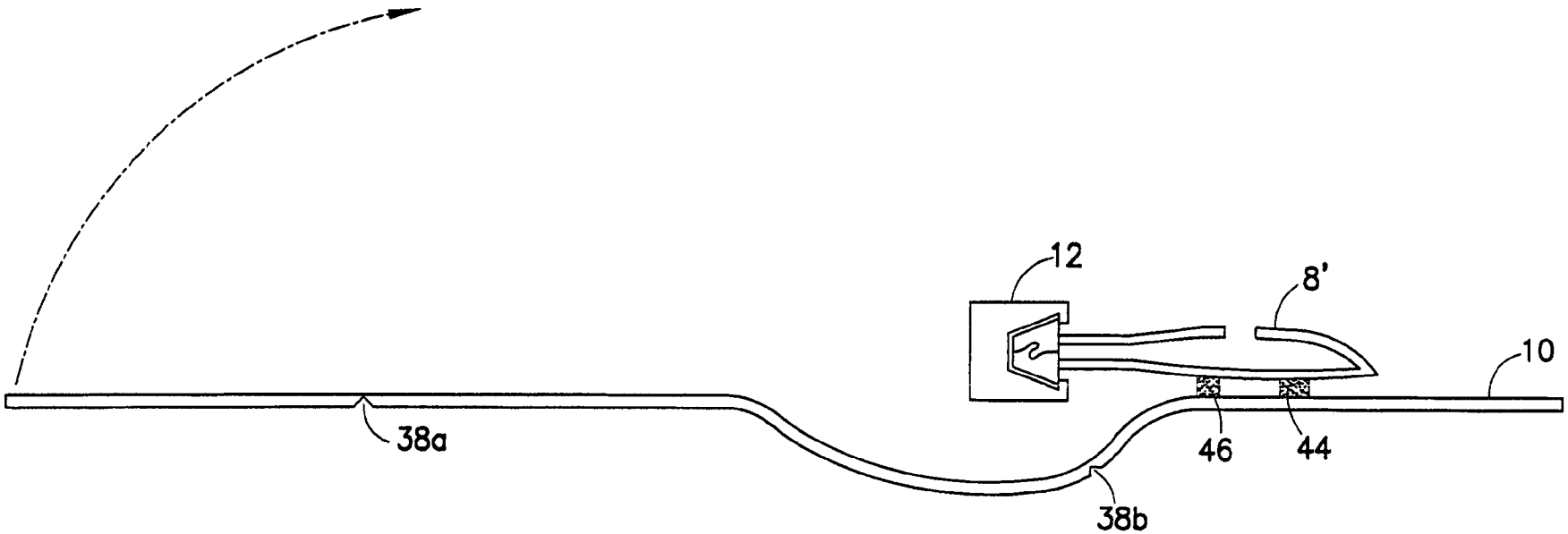
FIG. 7 is a drawing showing several steps of one method of manufacturing the shrouded slider-zipper assembly shown in FIG. 6.

One method for making the assembly depicted in FIG. 6 is partly shown in FIG. 7. The long zipper flange 40 is conduction heat sealed to the web 10 along two zones to form permanent seals 44 and 46. Then the web is folded along a central area (as indicated by the curved dash-dot arrow), the folded-over portion overlying the slider-zipper assembly. The folded-over portion of the web 10 is then conduction heat sealed to the flanges 40 and 42 to form the permanent seals 48 and 50, seen in FIG. 6. Alternatively, the web could be folded first and then the slider-zipper assembly would be inserted between the sides of the folded web and sealed thereto.

Figure 9:
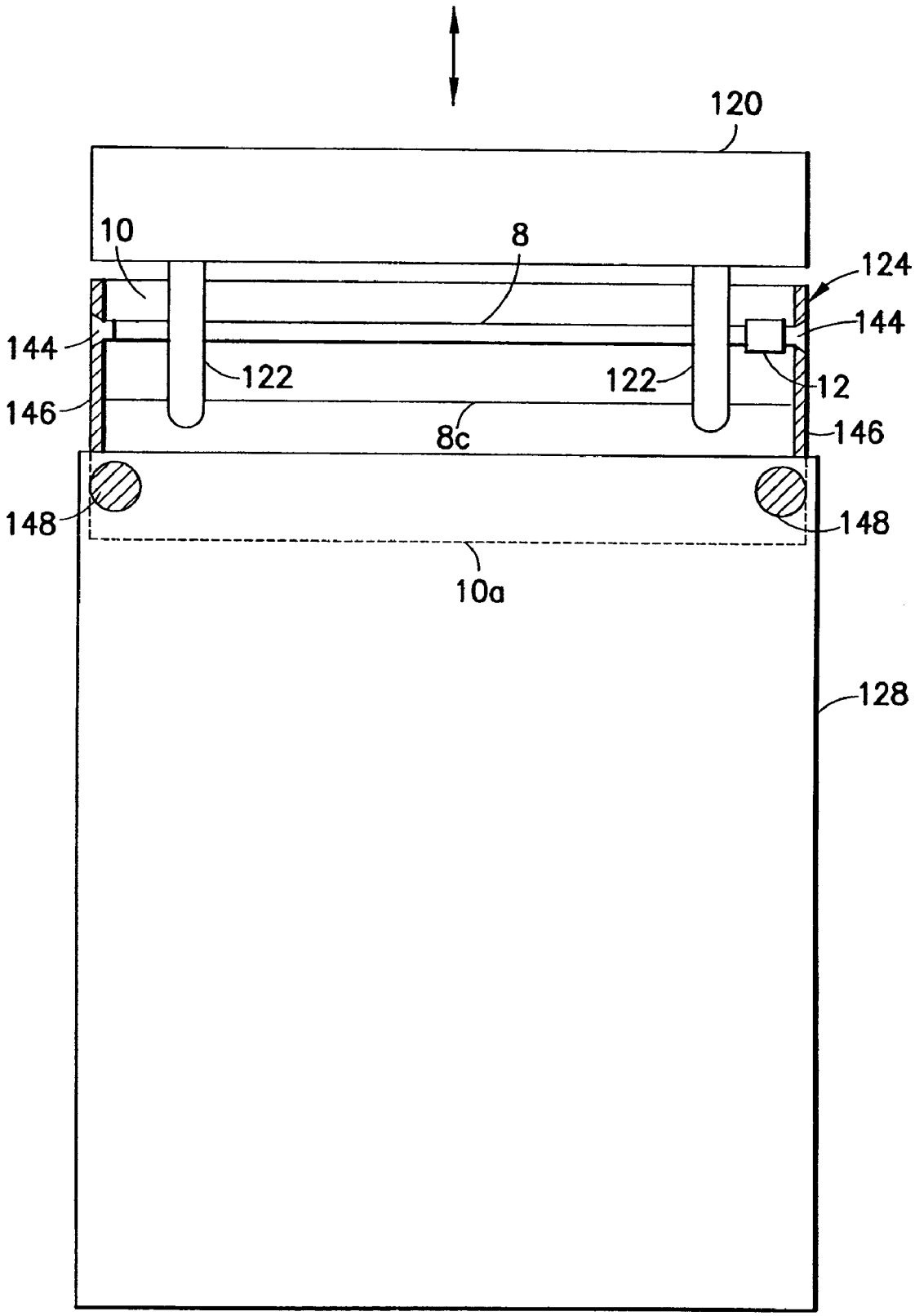
FIG. 9 is a drawing showing a shrouded slider-zipper assembly inserted into the mouth of a pre-made bag and tack sealed thereto, in accordance with the system depicted in FIG. 8.
Figure 10:
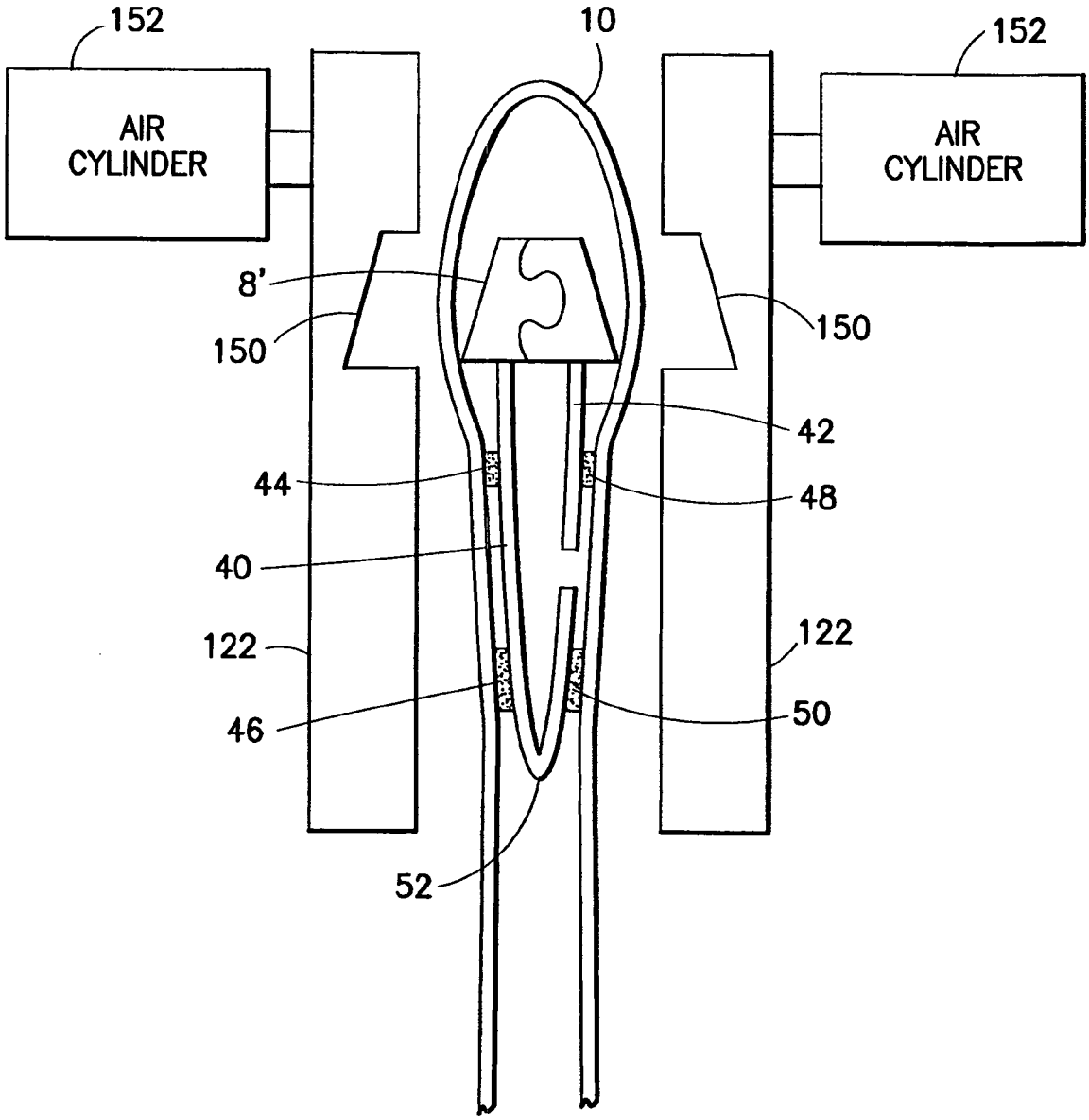
FIG. 10 is a drawing showing portions of a clamp for grasping and positioning a shrouded slider-zipper assembly in accordance with the system depicted in FIG. 8.

A method and an apparatus for making reclosable bags in accordance with one embodiment of the invention will now be described with reference to FIGS. 8 through 10. Starting with a spool of zipper 104 having sliders clipped thereon unwound at a zipper unwind station 106, a roll of plastic tape in the form of a film web 100 unwound at a tape unwind station 108, and a stack 126 of pre-made bags 128 open at both ends, the reclosable bags are assembled by an automated process. The machine has the layout generally depicted in FIG. 8.

Figure 8:
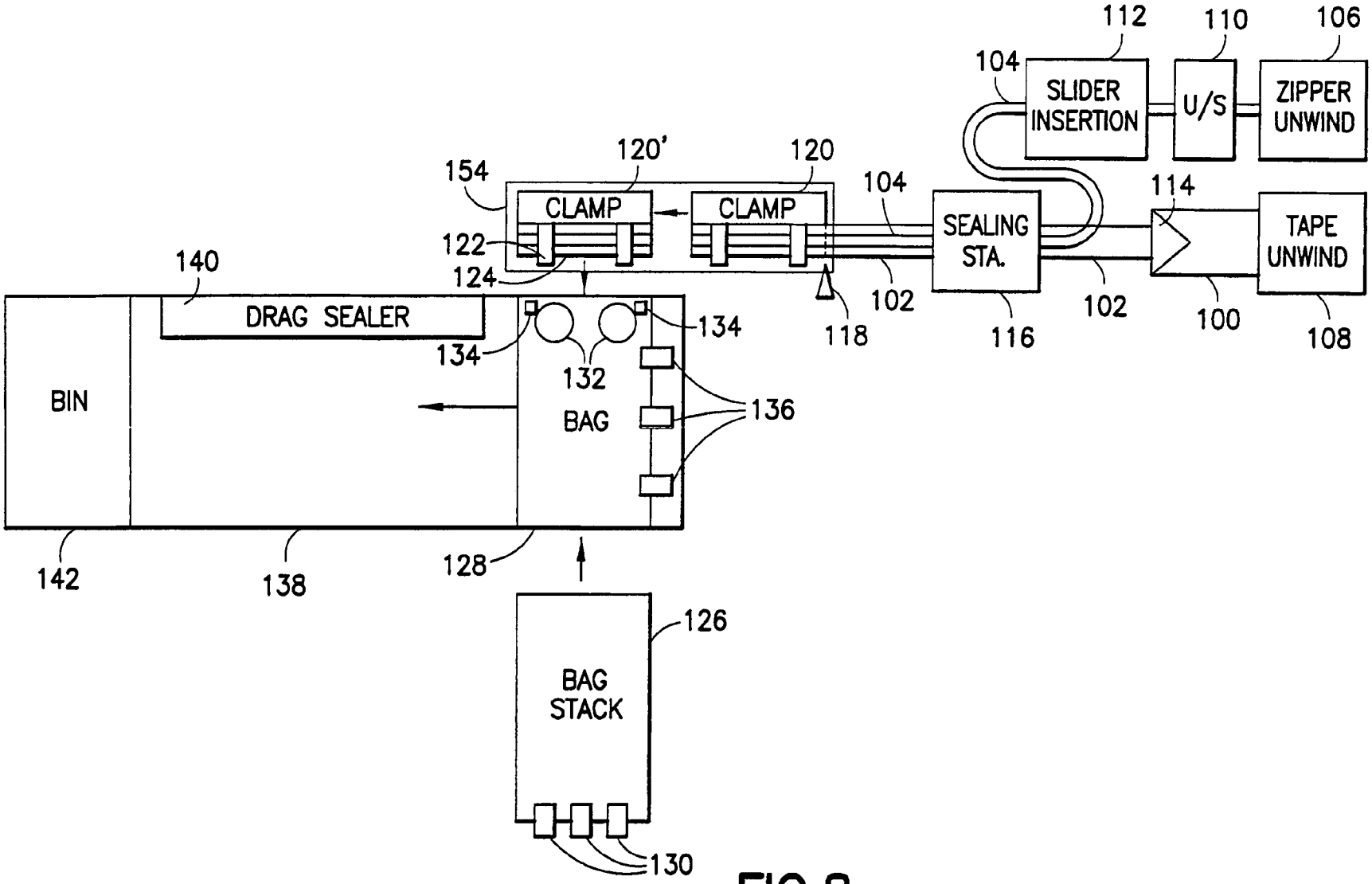
FIG. 8 is a drawing showing the layout of a system for manufacturing reclosable bags in accordance with one embodiment of the invention.

Referring to FIG. 8, the web 100 of film is paid out from a roll at the tape unwind station 108 and folded by a folding board 114. A continuous length of zipper (comprising interlocked zipper strips) is unwound from a spool at the zipper unwind station 106 and advanced to an ultrasonic welding station 110, where the zipper is ultrasonically crushed or stomped to form slider end stop structures at regular spaced intervals along the zipper, one slider end stop structure for each bag-width section of zipper. [The slider end stops 144, formed after the slider end stop structures have been bisected during cutting operations, can be seen in FIG. 9.] The crushed zipper is then advanced to a slider insertion device 112, where a respective slider is pushed or inserted onto each bag-width section of the zipper at a position between the slider end stop structures. The continuous length of zipper, with sliders and slider end stop structures (neither of which are shown in FIG. 8), is designated by numeral 104 at the exit to the slider insertion device. The slider-zipper assembly 104 is then passed around various guide rollers (not shown) and advanced by pinch rollers (not shown) to a zipper guide (not shown) at a zipper sealing station 116. Each guide roller may be provided with an annular peripheral recess to provide clearance for the slider as the length of zipper wraps around a portion of the roller's periphery. In the meantime, a web of film 100 is unwound from a roll at the tape unwind station 108 and advanced over a folding board 114 that folds the web in half. The folded web is designated by numeral 102 in FIG. 8. The folded web is also advanced to the sealing station 116 by pinch rollers (not shown).

At the sealing station 116, the advancing folded web 102 is opened up by a stationary web separator (not shown) and the advancing slider-zipper assembly 104 is guided by the zipper guide into the space between the two halves of the opened folded web 102. The sealing station 116 may comprise a pair of opposing retractable heated sealing bars, which seal the two sides of the web 102 to the two zipper flanges by conventional conduction heat sealing, thus forming a shrouded slider-zipper assembly—for example, of the type shown in either FIG. 2 or FIG. 6. A separator plate (not shown) may be disposed between the zipper flanges to prevent seal-through of the flanges. In addition, the shroud is cross sealed at regular intervals, one cross seal per package-width section. [These cross seals are later bisected during the same cutting operation that bisects the slider end stop structures, the end result being the transverse side seals 146 seen in FIG. 9.]

The most recently sealed section of the shrouded slider-zipper assembly is then advanced to a clamp 120 comprising two pairs of mutually opposed retractable fingers 122. The movement of the fingers of each pair is coordinated to provide clamping and release. Initially the clamp is open while the leading package-width section of the shrouded slider-zipper assembly is advanced to a position in registration with the clamp. Then the retractable fingers is actuated to displace from their retracted positions (as seen in FIG. 10) to their extended positions. In the extended positions, the fingers clamp the leading section of the shrouded slider-zipper assembly, holding it secure while a knife 118 (see FIG. 8) makes a transverse cut across the continuous length of shrouded slider-zipper assembly, thereby severing an individual shrouded slider-zipper assembly. That individual assembly is held securely by the clamp 120. The fingers 122 of the clamp can be actuated by any conventional means. For example, FIG. 10 depicts a pair of fingers 122 actuated by respective air cylinders. Alternatively, solenoids, hydraulic cylinders, motors or other means could be used. Each finger 122 may be provided with a recess 150. The recesses 150 are shaped to provide clearance for the zipper profiles (which in this example form a trapezoidal profile) when the fingers are extended to clamp the shrouded slider-zipper assembly. The fingers are situated such that there is no interference from the slider.

In accordance with the disclosed embodiment of the invention, the clamp is movable in two dimensions in accordance with a program that carries the individual shrouded slider-zipper assembly into the open mouth of a pre-made bag 128. The movements of the clamp may be controlled by a programmed logic controller (not shown). The programmed logic controller would also control means for moving the open-ended pre-made bag 128 from a stack 126 to a bed 138 and means for opening the mouth at the top of the bag. Although the person skilled in the art will recognize that the clamp may be moved in different ways by different means, one embodiment will be described for the sake of illustration.

For example, the clamp 120 may be mounted on a plate (not shown) that is linearly displaceable relative to a carriage (not shown), which carriage is in turn linearly displaceable along a track (not shown) built on a platform 154. The two movements are indicated by respective arrows shown in FIG. 8, which arrows are mutually orthogonal. These linear displacements could be actuated using rack and pinion assemblies or equivalent means. In the first phase, the carriage, which carries the plate to which the clamp is mounted, is moved from the cutting station to a position opposite the mouth of a pre-made bag 128. To distinguish these two positions, the clamp is shown twice in FIG. 8. The clamp when positioned at the cutting station is designated by numeral 120; the clamp when positioned at the pre-insertion station is designated by numeral 120'. As the clamp moves, it carries the individual shrouded slider-zipper assembly 124 for insertion into the mouth of the bag 128.

In the meantime, a pre-made bag 128 is moved from stack 126 to the bed 138 by a set of rubberized wheels 130, only one bank of wheels being shown in FIG. 8. When in position, two sets of suction cups 132 on opposite sides of the bag are activated to open the mouth of the bag. The suction cups positioned below the bag are not visible in FIG. 8. While the mouth is opened, the programmed logic controller actuates movement of the plate carrying the clamp toward the bag mouth. The end result of this operation is shown in FIG. 9.

Only portions of both sides of the shroud 10 are inserted into the bag mouth. The edge 10*a* of one side of the shroud is indicated by a dashed line in FIG. 9 to show its presence inside the bag. The edge of the other side, not visible in FIG. 9, lies behind the visible side. In this position, the programmed logic controller actuates two sets of mutually opposing retractable tack sealers 134 (see FIG. 8), which tack seal the shrouded slider-zipper assembly 124 to both walls of the pre-made bag 128. The resulting tack seals 148 are shown in FIG. 9. Referring again to FIG. 8, the programmed logic controller then actuates the various components as follows: the tack sealers 134 are retracted; the fingers 122 on the clamp 120' are retracted to release the shrouded slider-zipper assembly 124; the mounting plate that carries the empty clamp 120' is retracted; the carriage that carries the clamp mounting plate and the empty clamp is moved back to the cutting station; the pre-made bag 128 is moved from right to left (as seen in FIG. 8) by another set of rubberized wheels 136, only one bank of wheels being shown. It should be understood that respective banks of rubberized wheels can be arranged at spaced intervals along the bed 138 to move the bag 128 along the entire length of the bed. During this movement, the mouth of the bag with the shrouded slider-zipper assembly tack sealed therein is passed through a continuous-motion drag sealer 140, which joins the sides of the shroud to the walls (and two gusset panels, as previously discussed with reference to FIG. 5) of the bag along the full width of the shroud. However, it should be understood that the final sealing operation could alternatively be performed using an intermittent-motion sealing arrangement, such as the sealing bars used to seal the zipper to the shroud.

A typical drag sealer comprises a first and second pairs of opposing heated sealing bars (not shown). As the bag mouth and shrouded slider-zipper assembly advance continuously between the opposing sets of sealing bars, the respective sides of the shroud are sealed to the opposing walls of the bag. The sealing is accomplished by electrically heating the sealing bars, the heat being conducted through respective endless barrier strips made of Teflon or similar material, which circulate on respective sets of rollers (not shown). In the gaps between the opposing sealing bars, the bag and shrouded slider-zipper assembly are sandwiched between and held together by the Teflon barrier strips, which move with the bag and shrouded slider-zipper assembly.

After the shrouded slider-zipper assembly 124 has been sealed inside the mouth of the pre-made bag 128, the finished reclosable is discharged into a bin 142. The bin is then transported to a filling station, where the reclosable bags are filled with product from the bottom. In the case of pet food, the bag may be filled with 50 pounds of product, which is dropped into the bag. To withstand this impulse, the zipper should have a relatively high burst strength. After filling, the bottom of the bag is sealed by joining the internal sealant layers of the laminated material.

While the invention has been described with reference to various embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the verb "joined" means fused, bonded, sealed, or adhered, whether by application of heat and/or pressure, application of ultrasonic energy, application of a layer of adhesive material, peel seal material, or bonding agent, interposition of an adhesive or bonding strip, etc.

The invention claimed is:

1. A method of manufacture comprising the following steps:

(a) mounting a slider to a zipper comprising interlocked first and second zipper strips;

(b) folding a length of a web along a fold line;

(c) joining a portion of a length of a first flange of said first zipper strip to a first portion of said length of said web;

(d) joining a portion of a length of a second flange of said second zipper strip to a second portion of said length of said web, said first and second portions of said length of said web being on opposite sides of said fold line;

(e) cutting said joined lengths of said web and said zipper along first and second lines generally perpendicular to a lengthwise direction of said web to form an individual shrouded slider-zipper assembly that includes said slider;

(f) joining a third portion of said length of said web to a first portion of a pre-made bag that partly defines a mouth; and (g) joining a fourth portion of said length of said web to a second portion of said pre-made bag that partly defines said mouth, wherein steps (f) and (g) are performed after step (e).

2. The method as recited in claim 1, wherein step (b) is performed prior to steps (c) and (d).

3. The method as recited in claim 1, wherein step (b) is performed subsequent to step (c) and prior to step (d).

4. The method as recited in claim 1, further comprising the step of forming a line of weakened tear resistance in said length of said web, said line of weakened tear resistance being disposed in a lengthwise direction.

5. The method as recited in claim 1, further comprising the step of joining a pull bead to a fifth portion of said length of said web prior to said folding step.

6. The method as recited in claim 1, further comprising the step of inserting a portion of said individual shrouded slider-zipper assembly inside said mouth of said pre-made bag prior to performing steps (f) and (g).

7. The method as recited in claim 1, further comprising the following steps:

clamping said individual shrouded slider-zipper assembly during said cutting step;

opening said mouth of said pre-made bag; and moving said clamped individual shrouded slider-zipper assembly from a location whereat said cutting step is performed to a position whereat a portion of said clamped individual shrouded slider-zipper assembly is disposed inside said open mouth.

8. The method as recited in claim 1, further comprising tack sealing said length of said web to said pre-made bag prior to steps (f) and (g).

* * * * *